US007757596B1

(12) United States Patent
Sundvall

(10) Patent No.: US 7,757,596 B1
(45) Date of Patent: Jul. 20, 2010

(54) SHELL RESTRAINING DEVICE FOR AN ANTI-ARMOUR WEAPON

(75) Inventor: Kenneth Sundvall, Stora Sundby (SE)

(73) Assignee: SAAB AB, Linköping (SE)

( * ) Notice: Subject to any disclaimer, the term of this patent is extended or adjusted under 35 U.S.C. 154(b) by 727 days.

(21) Appl. No.: 11/651,578

(22) Filed: Jan. 10, 2007

(30) Foreign Application Priority Data

Jan. 10, 2006 (EP) ..... 06100195

(51) Int. Cl.
*F41A 9/00* (2006.01)

(52) U.S. Cl. ..... 89/45; 206/3

(58) Field of Classification Search ..... 89/45; 206/3

See application file for complete search history.

(56) References Cited

U.S. PATENT DOCUMENTS

| | | | | |
|---|---|---|---|---|
| 1,218,814 | A * | 3/1917 | Steinmetz | 206/3 |
| 2,308,480 | A | 1/1943 | Abbott et al. | |
| 2,739,746 | A * | 3/1956 | Hayes et al. | 224/610 |
| 3,266,372 | A * | 8/1966 | Mack et al. | 89/1.51 |
| 3,424,298 | A * | 1/1969 | Snow et al. | 206/3 |
| 4,199,093 | A * | 4/1980 | Combette et al. | 227/9 |
| 4,279,339 | A * | 7/1981 | Gotter | 206/3 |
| 4,940,135 | A * | 7/1990 | Hall | 206/3 |
| 6,357,582 | B1 * | 3/2002 | Fischer | 206/3 |

FOREIGN PATENT DOCUMENTS

| | | |
|---|---|---|
| BE | 670538 A | 2/1966 |
| FR | 1161985 A | 9/1958 |

OTHER PUBLICATIONS

European Search Report.

* cited by examiner

*Primary Examiner*—Troy Chambers
*Assistant Examiner*—Samir Abdosh
(74) *Attorney, Agent, or Firm*—Venable LLP; Eric J. Franklin

(57) ABSTRACT

A device for restraining a shell in a barrel of a disposable anti-armour weapon being stored in a compartment of a transport box. A stopper member is configured to be placed in the barrel in front of and adjacent to a shell loaded therein. The stopper member has at least three radially expandable legs, which are distributed circumferentially and configured to face and engage a tapered front surface of the shell in the barrel. The legs are provided with gripping elements on radially outermost surfaces thereof and configured to cut into the barrel wall upon a forward movement of the shell in the barrel.

3 Claims, 1 Drawing Sheet

SHELL RESTRAINING DEVICE FOR AN ANTI-ARMOUR WEAPON

CROSS-REFERENCE TO RELATED APPLICATIONS

This application claims priority to European patent application 06100195.4 filed Jan. 10, 2006.

BACKGROUND OF THE INVENTION

1. Technical Field of the Invention

The present invention relates to a device for restraining a shell in a barrel of an anti-armour weapon. More particularly, the invention relates to a shell restraining device which is mainly adapted for use with a disposable, preloaded anti-armoured weapon being stored in compartment of a transport box, in order to prevent the shell from exiting the barrel and detonating should the propellant charge of the shell accidentally ignite.

2. Description of Related Art

When transporting and storing disposable, preloaded anti-armour weapons in boxes there is in some cases a potential chance of an accidental firing of the propellant charge and a closely following detonation, if the shell should exit the barrel of the weapon, which would lead to possible fatal consequences. Up till now the related technical field lacks a suitable solution to this problem.

SUMMARY OF THE INVENTION

It is an object of the present invention to provide a shell restraining device which is capable of preventing a shell from exiting the barrel of the weapon should the propellant charge of the shell be accidentally ignited during transportation or storage of the anti-armoured weapon in a compartment of a box, and thereby preventing an accidental explosion of the shell.

For this purpose the device of according to the present invention comprises a stopper member configured to be placed in the barrel in front of and adjacent to a shell loaded therein, said stopper member having a central body carrying at least three radially expandable, rearwardly extending legs, which are distributed circumferentially and configured to face and engage a tapered front surface of the shell in the barrel, said central body having a front stopping element for engaging a front wall of the compartment of the transport box, and said legs being provided with gripping elements on radially outermost surfaces thereof facing the adjacent inner surface of the barrel and configured to cut into the wall of the barrel and to be possitively coupled thereto upon a forward movement of the shell in the barrel. During the initial movement forward of the shell in the barrel the stopper member will immediately expand radially owing to a key action between the tapered front surface of the shell and the legs of the stopper member such that the legs will be kinematically coupled to the barrel, which is normally made of a plastic material, such as fiber-reinforced composite material.

Further features of the device of the invention will be apparent from the following detailed description and the appended dependent claims with reference to the accompanying drawing.

DESCRIPTION OF A PREFERRED EMBODIMENT OF THE INVENTION

Figure 1:
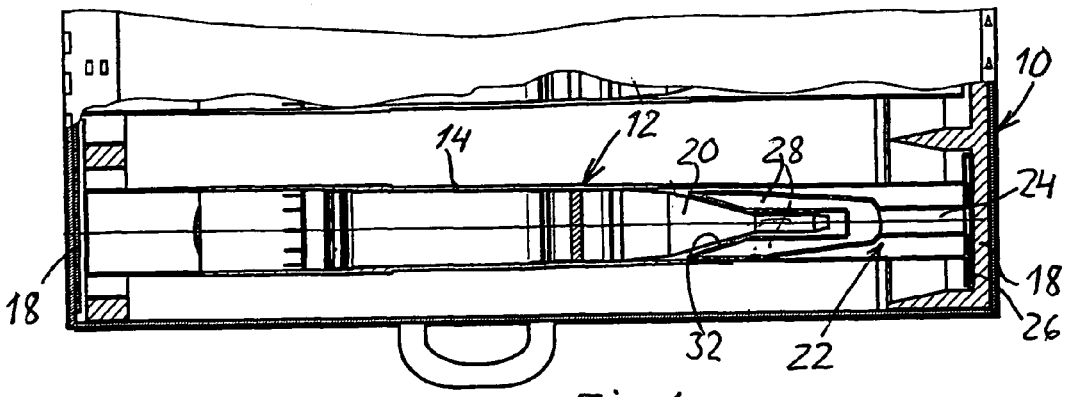
FIG. 1 is a schematic partial side view of a shell stopper for an anti-armoured weapon stored in a compartment of a transport box.
Figure 2:
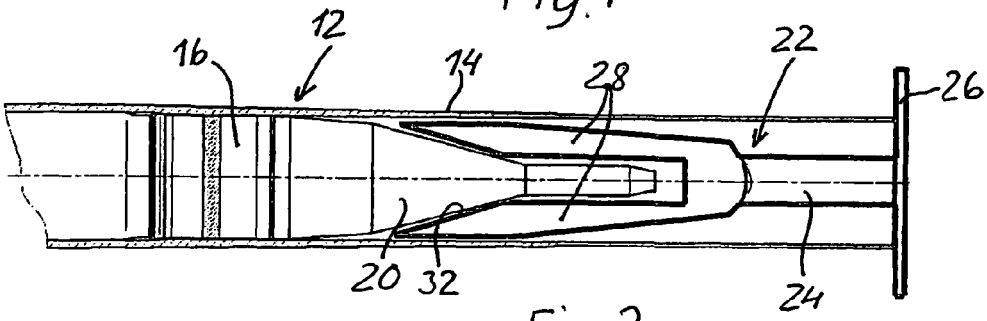
FIG. 2 is a schematic enlarged fractional side view of the stopper in FIG. 1.

FIG. 1 illustrates a transport box 10 for disposable, preloaded anti-armoured weapons 12. For example, each box may preferably contain two, three or four weapons 12, but only one is shown in FIG. 1. The disposable, preloaded anti-amour weapon 12 includes a barrel 14 of a fiber-reinforced composite material and a shell 16 loaded therein. Each weapon 12 is snugly lodged between end walls 18 of a separate compartment of the box 10 so that the barrel 14 is unable to move axially and radially therein. The shell 16 has a conventional tapered nose portion 20.

Figure 4:
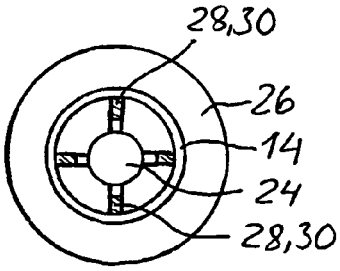
FIG. 4 is a schematic cross-sectional view through the barrel and the leg portion of the stopper.

According to the present invention, in order to prevent the shell 16 from exiting the barrel 14 should the propellant charge (not shown) of the shell 16 for any reason be accidentally ignited during transportation or storage thereof, e.g. in case of fire, a stopper member 22 is mounted in front of the shell 16. The stopper member 22 comprises a central, axially extending body 24 having a front stopping plate 26 for engaging a front end wall 18 of the compartment of the transport box 10, and a plurality of radially expandable legs 28, which extend rearwardly from the central body 24 and are preferably evenly distributed circumferentially and configured to face and engage the surface of the tapered nose portion 20 of the shell 16 in the barrel 14. Even though at least three such legs 28 must be provided to stabilize the stopper member 22 in the barrel 14, four such legs 28 are provided in the embodiment described herein, as shown schematically in FIG. 4.

Figure 3:
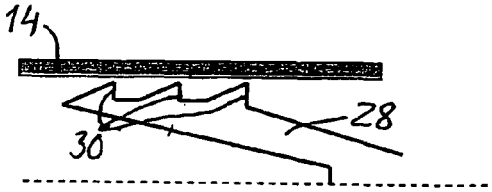
FIG. 3 is a schematic fractional side view of a leg portion of the stopper in FIGS. 1 and 2.

As shown in FIG. 3, each leg 28 is provided with gripping elements 30 on the radially outermost surfaces thereof facing the closely adjacent inner surface of the barrel 14. The gripping elements 30 may be saw-tooth shaped or the like so as to accomplish a positive engagement between the legs 28 of the stopper member 22 and the barrel 14 if, due to an accidental ignition of the propellant charge of the shell 16, the latter commences to accelerate forward in the barrel 14. In such a case, the tapered nose portion 20 of the shell 16 will create a key action between this portion of the shell 16 and corresponding radially inwardly facing, tapered surfaces 32 of the legs 28 of the stopper member 22 which will cause the legs 28 to immediately expand radially and cut into the wall of the barrel 14 to accomplish a locking of the shell 16 to the barrel 14. The shell 16 is thus caused to entrain the barrel 14 in its movement forward thereby increasing the total mass to such an extent that an arming of the detonating fuze of the shell is prevented. If stored in a transport box 10 the total weight of the loaded weapon(s) 12 and the box 10 will be sufficiently high to render the projectile(s) 16 harmless. Also, the gripping elements 30 may be configured to cut up the barrel wall so that the propellant gas could be evacuated so as to prevent the detonating fuze from being armed. This inventive stopper device will significantly enhance the so called IM (Insensitive Munitions) characteristics of preloaded anti-armoured weapons.

The invention claimed is:

1. A device for restraining a shell in a barrel of an anti-armour weapon, in particular adapted for a disposable, preloaded anti-armoured weapon being stored in a compartment of a transport box, the device comprising:

a stopper member configured to be placed in the barrel in front of and adjacent to a shell loaded therein, said stopper member comprising a central body comprising at least three radially expandable, rearwardly directed legs, which are distributed circumferentially about the central body and are each configured to face and engage a tapered front surface of the shell in the barrel, said central body comprising a front stopping element for engaging a front wall of the compartment of the transport box when the stopper member is arranged in the barrel and the shell and stopper member are being stored in the compartment of the transport box, and said legs comprising gripping elements arranged on radially outermost surfaces of the legs and facing an adjacent inner surface of the barrel and configured to cut into the barrel wall upon a forward movement of the shell in the barrel.

2. The device according to claim 1, wherein the legs comprise, on radially inwardly facing surfaces thereof, a tapered profile substantially corresponding to the tapered front surface of the shell.

3. The device according to claim 1, wherein the gripping elements of the expandable legs have a saw-tooth profile.

* * * * *